US011323792B2

(12) United States Patent
Newlove

(10) Patent No.: US 11,323,792 B2
(45) Date of Patent: May 3, 2022

(54) FRONT MOUNTED FLAT PANEL LOUDSPEAKER ASSEMBLY

(71) Applicant: Amina Technologies Limited, Huntingdon (GB)

(72) Inventor: Richard Newlove, Huntingdon (GB)

(73) Assignee: AMINA TECHNOLOGIES LIMITED, Huntingdon (GB)

( * ) Notice: Subject to any disclaimer, the term of this patent is extended or adjusted under 35 U.S.C. 154(b) by 0 days.

(21) Appl. No.: 17/107,660

(22) Filed: Nov. 30, 2020

(65) Prior Publication Data

US 2021/0160600 A1 May 27, 2021

Related U.S. Application Data

(63) Continuation of application No. PCT/GB2019/051588, filed on Jun. 7, 2019.

(30) Foreign Application Priority Data

Jun. 7, 2018 (GB) ..... 1809382
Aug. 21, 2018 (GB) ..... 1813621

(51) Int. Cl.
*H04R 1/02* (2006.01)
*H04R 7/04* (2006.01)

(52) U.S. Cl.
CPC ..... *H04R 1/025* (2013.01); *H04R 7/045* (2013.01); *H04R 2400/11* (2013.01); *H04R 2440/05* (2013.01)

(58) Field of Classification Search
CPC .... H04R 1/025; H04R 7/045; H04R 2400/11; H04R 2440/05

(Continued)

(56) References Cited

U.S. PATENT DOCUMENTS 3,494,444 A * 2/1970 Coen ..... B21D 51/16 181/171
4,673,149 A * 6/1987 Grote ..... E04B 9/006 248/27.1

(Continued)

FOREIGN PATENT DOCUMENTS

CN 205123976 U 3/2016
EP 1179967 A2 2/2002

(Continued)

OTHER PUBLICATIONS

GB1809382.3, "Combined Search and Examination Report", dated Jan. 23, 2019, 5 pages.

(Continued)

*Primary Examiner* — Sean H Nguyen
(74) *Attorney, Agent, or Firm* — Kilpatrick Townsend & Stockton LLP

(57) ABSTRACT

A flat panel loudspeaker includes a planar resonant panel insertable into an opening in the mounting surface and including a front surface and a rear surface. The front surface faces outward in the mounting surface. The loudspeaker also includes an exciter coupled to the rear surface of the planar resonant panel and a support frame for mounting in the mounting surface. The rear surface of the planar resonant panel is fixed thereto around substantially the whole of the outer boundary of the planar resonant panel. The outer boundary of the planar resonant panel is fixed relative to the mounting surface. The loudspeaker further includes at least one tab configured to extend away from the support frame and be substantially flush with the front surface of the planar resonant panel, which is substantially flush with the mounting surface when the tab is against the mounting surface.

23 Claims, 6 Drawing Sheets

(58) Field of Classification Search
USPC ..... 381/332
See application file for complete search history.

(56) References Cited

U.S. PATENT DOCUMENTS

| | | | | |
|---|---|---|---|---|
| 4,778,134 | A | 10/1988 | Struthers et al. | |
| 2001/0055402 | A1* | 12/2001 | Azima | H04R 1/24 381/152 |
| 2004/0105567 | A1* | 6/2004 | Kurihara | B60R 11/0217 381/386 |
| 2005/0111689 | A1* | 5/2005 | True | H04R 31/006 381/423 |
| 2010/0050537 | A1 | 3/2010 | Murray | |
| 2012/0134518 | A1* | 5/2012 | Otani | H04R 1/023 381/189 |

FOREIGN PATENT DOCUMENTS

| | | | | |
|---|---|---|---|---|
| EP | 1180914 | A2 | 2/2002 | |
| EP | 1204295 | A1 | 5/2002 | |
| GB | 2537617 | A * | 10/2016 | H04R 1/025 |
| GB | 2544548 | A | 5/2017 | |

OTHER PUBLICATIONS

PCT/GB2019/051588, "International Search Report and Written Opinion", dated Sep. 4, 2019, 13 pages.

* cited by examiner

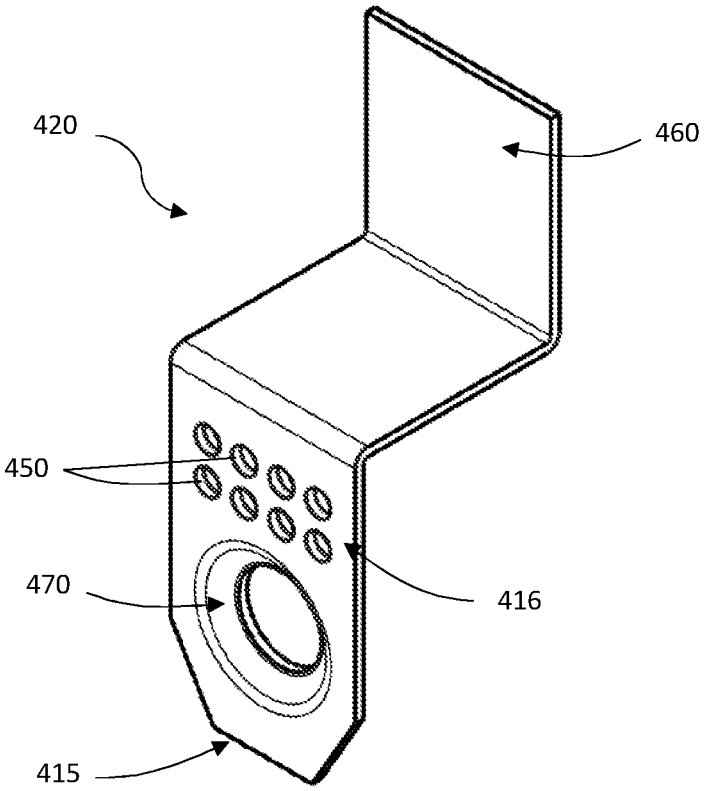
Fig. 5A
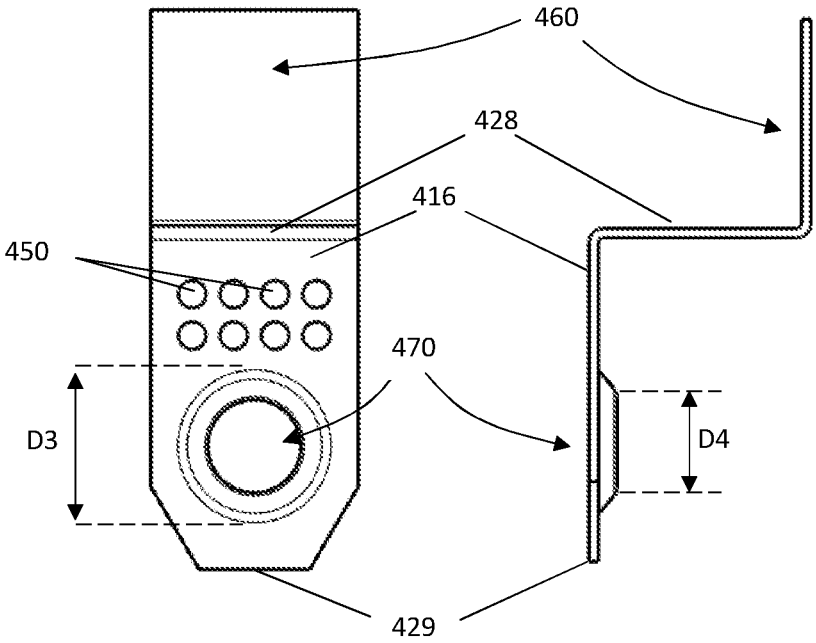
Fig. 5B
Fig. 5C

FRONT MOUNTED FLAT PANEL LOUDSPEAKER ASSEMBLY

CROSS-REFERENCES TO RELATED APPLICATIONS

This application claims priority to and is a continuation of International Patent Application No. PCT/GB2019/051588, filed Jun. 7, 2019, which claims priority to GB Patent Application No. 1809382.3, filed Jun. 7, 2018 and GB Patent Application No. 1813621.8, filed Aug. 21, 2018, the entire contents of which are hereby incorporated by reference in their entirety for all purposes.

BACKGROUND OF THE INVENTION

This invention relates to a mounting arrangement for a device, such as a flat panel speaker, to be mounted in a surface, such as a wall, so as to be flush or substantially flush with the surface. This invention relates, in particular, to a flat panel loudspeaker and a method of mounting the same in a mounting surface.

Flat panel loudspeakers can be installed in an opening defined in a surface of a building, such as a surface of a wall, a floor, or a ceiling. A front surface of a resonant panel of the flat panel loudspeaker is arranged to be substantially flush with, for example, the surface of the wall. One general appeal of flat panel loudspeakers installed in this way is that a flat panel loudspeaker can be made to look invisible. Once such a flat panel loudspeaker is mounted in the opening of the surface, the flat panel loudspeaker can be made "invisible" by blending the surface with a boundary of the flat panel loudspeaker insofar as it is generally not apparent that the flat panel of a loudspeaker forms part of the surface (or that the surface defines an opening therein).

To make the loudspeakers "invisible" where the surface of walls is to be formed by plastering, e.g. over plasterboard hung on stud walls, the flat panel loudspeaker can be mounted in an opening in the plastered wall to be flush with the wall surface, and then a skim that is applied to finish the plastered wall is also applied over the flat panel of the loudspeaker, thereby giving it substantially the same finish as the wall with which it is flush, making it invisible.

Another form of wall construction that is common in certain markets is drywall lining, in which drywall gypsum boards are attached to stud walls to form the wall surface. The drywall boards themselves provide the wall finish, and so no plastering or finishing skim is applied. Rather, only the joints between the drywall boards are masked by the application of jointing tape and jointing compound to conceal them.

To make the loudspeakers "invisible" where the surface of walls is provided by drywall boards, the flat panel loudspeakers can be mounted in stud walls alongside drywall lining boards. However, due to the taping and jointing, flat composite panel loudspeakers can be more difficult to conceal as the jointing tape can stand proud of the speaker surface.

It is in the above context that the present disclosure has been devised.

SUMMARY OF THE INVENTION

It is in the above context that the present disclosure has been devised.

Viewed from one aspect, the present invention provides a flat panel loudspeaker configured for mounting in an opening in a mounting surface. The flat panel loudspeaker comprises a planar resonant panel insertable into an opening in the mounting surface and having a front surface. The front surface is to face outwardly in the mounting surface when the flat panel loudspeaker is mounted in the mounting surface. The resonant panel further has a rear surface opposite the front surface. The loudspeaker further comprises an exciter coupled to the rear surface of the resonant panel to cause the resonant panel to vibrate on operation of the exciter, to generate sound. The loudspeaker additionally comprises a support frame for mounting in the mounting surface and having the rear surface of the resonant panel fixed thereto around substantially the whole of the outer boundary of the resonant panel, such that when mounted in the mounting surface and when the resonant panel is caused by the exciter to vibrate on operation of the exciter, the outer boundary of the resonant panel is fixed relative to the mounting surface. The loudspeaker also comprises at least one tab, configured to extend away from the support frame in a tab direction parallel to the mounting surface and substantially flush with the front surface of the resonant panel when the loudspeaker is to be mounted in the mounting surface, whereby to keep the front surface of the resonant panel substantially flush with the mounting surface when the tab is against the mounting surface.

Advantageously, the at least one tab ensures that the flat panel loudspeaker cannot be pushed too far into the opening in the mounting surface. In particular, where the flat panel loudspeaker is pushed into the opening in the mounting surface, the tabs will press against the mounting surface. It is not possible to insert the flat panel loudspeaker further within the opening than the position in which the tab is pressed against the mounting surface. Therefore, the resonant panel of the flat panel loudspeaker will always be provided flush with the mounting surface during mounting, regardless of the thickness of, for example, plasterboard providing the mounting surface. Furthermore, flat panel loudspeakers of this type cannot easily be mounted at a position other than that required for the flat panel loudspeaker to be mounted flush with the mounting surface. This ensures that such flat panel loudspeakers can be installed without a highly skilled expert tradesman and are suitable for mounting by consumers and home-owners as part of DIY home improvement projects.

It will be understood that the term "substantially flush" in relation to the front surface of the resonant panel being substantially flush within the mounting surface includes where the front surface of the resonant panel is exactly flush with the mounting surface. In some examples, there may be small differences between the front surface of the resonant panel and the mounting surface, such as less than two millimeters. Any differences between the front surface of the resonant panel and the mounting surface are typically of such a size that it will still be possible to provide an "invisible" flat panel loudspeaker of acceptable audio performance when a plaster coating is applied to the front surface of the resonant panel and the mounting surface to hide the flat panel loudspeaker.

It will be understood that "substantially flush" in relation to the at least one tab being substantially flush with the front surface of the resonant panel includes where a front surface of the at least one tab, that is the surface which faces away from the mounting surface, is exactly flush with the front surface of the resonant panel. The term "substantially flush" also includes where a bottom surface of a tab, that is the surface which is pressed against the mounting surface during installation, is exactly flush with the front surface of the resonant panel. In some examples, there may be small differences between the front surface of the resonant panel and a surface of the at least one tab, such as less than 2 millimeters. Any differences between the front surface of the resonant panel and a surface of the tab are typically of such a size that it will still be possible to provide an "invisible" flat panel loudspeaker of acceptable audio performance when a plaster coating is applied to the front surface of the resonant panel and the mounting surface to hide the flat panel loudspeaker.

It will be understood that the term "tab" includes any structural feature extending away from the support frame in the tab direction parallel to the mounting surface and substantially flush with the front surface of the resonant panel when the loudspeaker is to be mounted in the mounting surface. The tab need not extend from only a portion of the support frame, but may, in some embodiments, extend from substantially an entire boundary of the support frame.

The at least one tab may be a plurality of tabs. The plurality of tabs may be distributed around a boundary of the resonant panel. The at least one tab may comprise, for example, four tabs.

The at least one tab may be provided substantially at a corner of the front surface of the resonant panel. Each corner of the front surface of the resonant panel may be provided with a one of the at least one tab. Thus, there is a tab for each corner of the front surface of the resonant panel.

It will be understood that the term "substantially at a corner" in relation to at least one tab being substantially at a corner of the resonant panel includes where the at least one tab is provided exactly in the corner of the resonant panel. In some examples, there can be a support frame or mounting unit surrounding the periphery of the resonant panel. In these cases, the tab can be provided on the support frame or mounting unit in a location that is close to the corner of the resonant panel. An edge of the tab may be within 5 cm, such as within 1 cm, of a corner of the resonant panel, the support frame or the mounting unit. The at least one tab may be located closer to a corner of the resonant panel than a center of an edge of the resonant panel. It will be understood that the term "corner" means any region of a boundary of the resonant panel where the rate of curvature of the boundary increases. In this way, it will be seen that a substantially circular resonant panel typically will have no corners.

Advantageously, having a tab provided substantially at each of the corners of the resonant panel helps keep the entirety of the front surface of the resonant panel substantially flush within the mounting surface when the tabs are against the mounting surface. This is particularly useful if the mounting surface is not perfectly uniform and flat. Having a tab provided at each of the corners helps to ensure that the entire periphery of the front surface of the resonant panel is as flush as possible with the mounting surface. Where the tabs are provided substantially away from the corners of the resonant panel, such as approximately in the center of each side of the resonant panel, the corners of the resonant panel may not be provided as flush with the mounting surface as would otherwise be possible. This would make it more difficult for the flat panel loudspeaker to appear invisible in the mounting surface, since more layers of plaster would be required to hide the entire loudspeaker in the mounting surface.

In another embodiment, the at least one tab may be provided generally at the corner but nevertheless spaced from the exact corners of the resonant panel, for example by at least 10 millimeters. In particular, an edge of the tab may be at least 10 millimeters from a nearest corner of the resonant panel. Thus, during transit of the resonant panel or the assembled flat panel loudspeaker the tabs can be provided at least slightly away from the corner and there will be a reduced chance of damage to the delicate tabs in transit.

The front surface of the resonant panel may be substantially rectangular. As with all rectangles, the front surface will have four main sides, comprising two short sides and two long sides. The at least one tab may extend in the tab direction beyond a one of the short sides.

It will be understood that the term "substantially rectangular" in relation to the front surface of the resonant panel being substantially rectangular includes where the front surface of the resonant panel may be exactly rectangular. In some examples, the corners of the front surface could be rounded, or otherwise not exactly square. In some examples, the corners could be not at exactly 90 degrees, for example between 80 and 100 degrees. In some examples, the two short sides could be of different lengths, and/or the two long sides could be of different lengths. It will be understood that differences in the sides of ten percent may still provide a substantially rectangular front surface of the resonant panel. Any differences in shape that render the front surface of the resonant panel not exactly rectangular are typically of such a size that it will still be possible to recognize the front surface of the resonant panel as a rectangle.

The at least one tab may extend in the tab direction beyond the short side by a first extension amount greater than any second extension amount by which the tab extends beyond the long side. Advantageously, this ensures that the installation of the loudspeaker with the tabs can still take place if there is limited space in the mounting surface in the direction extending past the long sides of the resonant panel. Viewed another way, for a mounting surface with limited space in a first direction, a larger flat panel loudspeaker can be installed because less space is sacrificed in the first direction for the at least one tab. Such an arrangement of tabs is advantageous where the flat panel loudspeakers are to be installed in ducting areas for rooms, for example where a narrowest extent of the mounting surface may be less than 40 centimeters. In other words, the at least one tab may be located to make the flat panel loudspeaker longer more than wider, where the largest dimension of the resonant panel is the length.

The at least one tab may extend from, or substantially from, the short side of the resonant panel. In other words the at least one tab may be connected to the rest of the flat panel loudspeaker at the short side of the resonant panel.

It will be understood that the term "substantially from" in relation to at least one tab extending substantially from the short side of the resonant panel includes where the at least one tab extends from the short side of the resonant panel. In some examples, a support frame or mounting unit may surround the periphery of the resonant panel. In these cases, the tab may extend from the support frame or mounting unit in a location that is close to a short side of the resonant panel, such that the tab extends directly from a short side of the support frame or mounting unit.

The at least one tab may extend only beyond the short side. In this way, the at least one tab does not increase the extent of the flat panel loudspeaker in a direction between the two long sides.

The at least one tab may have a thickness of less than 1 mm. Such a tab may sometimes be referred to as a thin tab.

Advantageously, the number of layers of plaster that are required to cover the tab to make it seem invisible can be reduced. The tab may appear invisible when the front surface of the tab is flush with any plaster coating applied to the mounting surface. The thicker the tab, the more layers of plaster that may be required on the mounting surface and the resonant panel to cover the tab. A thicker layer of plaster over the resonant panel may detrimentally affect the audio performance of the flat panel loudspeaker. In this way a thin tab ensures that the sound quality of the speaker is not impaired or muffled by the presence of a large number of layers of plaster.

Furthermore, if a tab is to be indented into the mounting surface as part of the installation of the flat panel loudspeaker in the mounting surface, the tab does not need to be indented as far into the mounting surface to be flush with the mounting surface if the tab is thin. It is therefore beneficial to have a thin tab, so that it is easier and quicker for the user to install the flat panel loudspeaker without the assistance of a skilled tradesperson. Yet further, where the tab is to be indented into the mounting surface as part of the installation of the flat panel loudspeaker, a thinner tab will typically be more malleable and therefore easier to conform to the shape of the mounting surface, again reducing the number of layers of plaster that may be required to hide the flat panel loudspeaker in the mounting surface.

The tab may have defined therein a through-recess having at least a partially concave boundary engageable by a headed fastener.

It will be understood that a through-recess is an opening in the tab. The opening may have a closed boundary, such as in a hole, or may have an open boundary, such as a notch or a channel.

Advantageously, the through-recess allows the tab to also be used for securing the loudspeaker to the mounting surface during mounting. The headed fastener can pass through the through-recess, such that the head of the headed fastener engages with the tab adjacent to the boundary, and the shaft of the headed fastener engages with the mounting surface. In this way, the flat panel loudspeaker can be secured to the mounting surface via the headed fastener. The headed fastener may be a threaded fastener, such as a screw. The headed fastener may be a nail, for hammering into the mounting surface. It will be understood that the headed fastener is not limited to the aforementioned fasteners and can be any component with a head and a shaft, where the head is wider than the shaft, which can be used to fasten the tab and the mounting surface together. The use of a concave boundary to the through-recess enhances the contact points available between the head of the fastener and the tab.

The recess may be an open recess. In other words, the boundary of the through-recess does not form a closed loop.

Advantageously, the recess being provided at an end of the tab as an open recess means that the tab can have a smaller surface area, since the tab does not need to be large enough to incorporate the entirety of a closed recess. Furthermore, where the tab is thin enough to bend during securement of the tab to the mounting surface with the headed fastener, depression of the end of the tab into the mounting surface does not cause a further portion of the tab to lift up away from the mounting surface. This is in contrast to a recess provided in a center of the tab, where a free end of the tab, away from the recess, may be caused to lift up away from the mounting surface where the tab is a thin tab.

The tab may be provided with diagonal cut-out either side of the through-recess. Thus, sharp corners of the tab, which may otherwise have lifted away from the mounting surface as a result of bending of the tab during securing of the headed fastener against the tab, are not present.

The recess may be countersunk. In other words, an opening in the front surface of the tab, providing a first side of the through-recess is of a larger extent than an opening in the rear surface of the tab, providing a second side of the through-recess. The recess may be referred to as a tapered recess.

Advantageously, this enables the head of the fastener inserted into the recess to be at least partially received in the recess. Thus, the headed fastener can be driven further into the mounting surface, because a bottom of the head of the headed fastener does not engage with the front surface of the tab, but engages with the tab at a point in the recess below the front surface of the tab. Since the bottom of the head is below the front surface of the tab, the top of the head can be flush with the top surface of the tab, or can be at least more flush than it would have been if the through-recess was not countersunk. This reduces the number of layers of plaster that are required to cover the headed fastener and the tab to make these components flush with the mounting surface. The headed fastener may also comprise a tapered head.

The recess may define a first recess portion extending from a front surface of the tab. The recess may define a second recess portion. The first recess portion may extend to the second recess portion. The second recess portion may extend to a rear surface of the tab. The second recess portion may taper more acutely than the first recess portion relative to an axis of the recess between the front surface of the tab and the rear surface of the tab. Thus, the recess can be a two stage-recess, configured to cut into a mounting surface.

The tab may be formed from metal, for example sheet metal. The metal may be stainless steel.

A boundary of the through-recess may define an open jaw region and a throat region. The throat region may be wider than the open jaw region. Thus, the through-recess may be arranged to substantially center the headed fastener therein. Furthermore, a width of the open jaw region may be insufficient to allow passage of the shaft of the headed fastener therethrough, such that the headed fastener may be captive within the through-recess.

The boundary of the through-recess may follow at least an arc of a circle. Thus, for a headed fastener having a circular head, substantially all points of the boundary of the through-recess will be in contact with the head of the headed fastener, providing a more secure mounting of the flat panel loudspeaker in the mounting surface.

The loudspeaker may further comprise a mounting unit for mounting in the surface and having the resonant panel and exciter provided therein. An assembly of the resonant panel and the exciter may be mounted to the mounting unit. Thus, the mounting unit can protect a rear portion of the resonant panel and/or the exciter prior to and during mounting of the flat panel loudspeaker in the mounting surface. In an embodiment, the mounting unit may be different from the support frame.

The at least one tab may extend from the mounting unit. The mounting unit may be substantially cuboidal. The mounting unit may comprise two short sides, spaced and each connecting two long sides. The at least one tab may extend directly from the short side of the mounting unit. Therefore, the tab can be considered to extend substantially from the short side of the resonant panel, because the short side of the resonant panel is substantially adjacent to the short side of the mounting panel.

A surface of the flat panel loudspeaker may have defined therein at least one opening arranged to facilitate sound to pass from the resonant panel, out of the loudspeaker, to a mounting cavity defined rearwardly of the mounting surface. Thus, the flat panel loudspeaker can generate low frequency sounds, even when the size of a cavity provided by the flat panel loudspeaker is small. The mounting cavity can be used to provide the resonance chamber required for high quality low frequency sound production. The sound can be passed from the flat panel loudspeaker into the mounting cavity via the at least one opening.

The at least one opening may be at least two openings, symmetrically arranged. The at least one opening may be defined in the mounting unit. The at least one opening may be defined in a rear surface of the mounting unit. The at least one opening may be arranged to facilitate sound to pass rearwardly from the resonant panel to the mounting cavity.

The rear surface of the mounting unit may be provided by a plurality of facets. Each of the plurality of facets may be substantially planar. Each of the plurality of facets may define a surface normal, defining a direction of the facet. The plurality of surface normal may define at least two different directions. Thus, the frequency response of the resonant chamber of the flat panel loudspeaker provided by the mounting unit may be improved compared to a single, planar, rear surface.

Each surface normal may define a different direction. Thus, the plurality of facets will each face a different direction.

The tab may be frangibly connected to the loudspeaker. For example, the tab may be frangibly connected to the support frame. The tab may be frangibly connected to the resonant panel. Thus, the tab can be removed from the loudspeaker after installation.

Viewed from another aspect, the present invention provides a method for mounting a flat panel loudspeaker in a mounting surface facing outwardly. The method comprises: inserting the flat panel loudspeaker as described hereinbefore into an opening defined in the mounting surface. The opening defined in the mounting surface is sized to fit the resonant panel of the loudspeaker therein. The flat panel loudspeaker is inserted until the at least one tab is against the mounting surface, with the front surface of the resonant panel substantially flush with the mounting surface; and securing the loudspeaker in the mounting surface. Thus, the flat panel loudspeaker can mounted such that the front surface of the resonant panel is substantially flush with the mounting surface in an efficient manner.

Although the present invention has been described in relation to a flat panel speaker, it will be appreciated that the invention extends to any device mountable in a surface, particularly where the device is to be seated in an opening in the surface, to pass close to the edge of the opening, and particularly where the device is to be substantially flush with the surface. The device may be a display panel, for example an electronic display panel.

Viewed from another aspect, the present invention provides a method for manufacturing a tab for the loudspeaker described hereinbefore. The method comprises forming the through-recess by a first punching operation using a first punch tool defining a first punch head and a second punching operation using a second punch tool defining a second punch head, subsequent to the first punching operation. Thus, the through-recess of the tab can be formed in a two-stage process allowing different geometric characteristics for different portions of the through-recess.

The first punch head may be smaller than the second punch head. Thus, the second punch head may affect portions of the tab during manufacture not engaged by the first punch head.

The first punch head may taper more acutely to a first punch tip than the second punch head tapers to a second punch tip. Thus, the method can be used to manufacture the tab as described herein, having the first recess portion and the second recess portion.

Forming the through-recess may comprise punching the first punch tool through a tab blank into a first punch receiver, the first punch receiver having defined therein a first opening sized to be just larger than the first punch tool whereby to substantially prevent deformation of a boundary of a first tab opening formed in the tab blank, during punching of the first punch tool into the tab blank. Forming the through-recess may comprise punching the second punch tool into the tab blank provided on a second punch receiver. The second punch receiver has defined therein a second opening sized to be larger than the second punch tool whereby to allow deformation of the boundary of the first tab opening formed in the tab blank, during punching of the second punch tool into the tab blank. Thus, the through-recess can be formed. Typically, during mounting to the mounting surface, the boundary of the through-recess will cut into the mounting surface, better allowing the tab to be provided flush with the mounting surface during mounting.

BRIEF DESCRIPTION OF THE DRAWINGS

Embodiments of the invention are further described hereinafter with reference to the accompanying drawings, in which:

FIGS. 5A, 5B and 5C are illustrations of a tab of the embodiment of FIG. 4.

DETAILED DESCRIPTION OF THE INVENTION

Figure 1A:
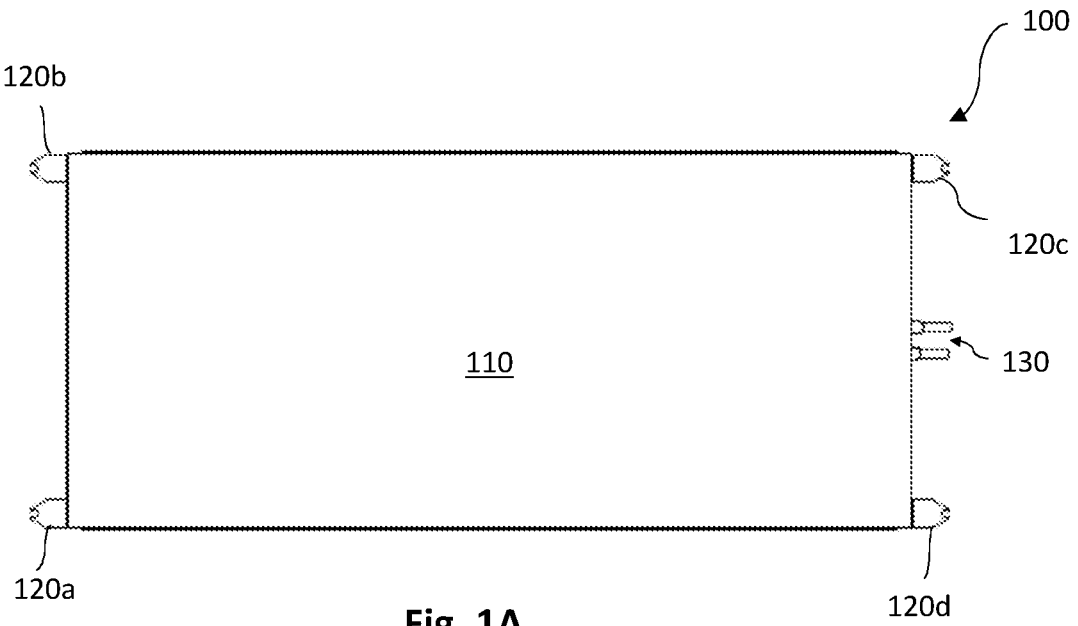
FIGS. 1A, 1B and 1C are illustrations of an embodiment of a flat panel loudspeaker as disclosed herein.
Figure 1B:
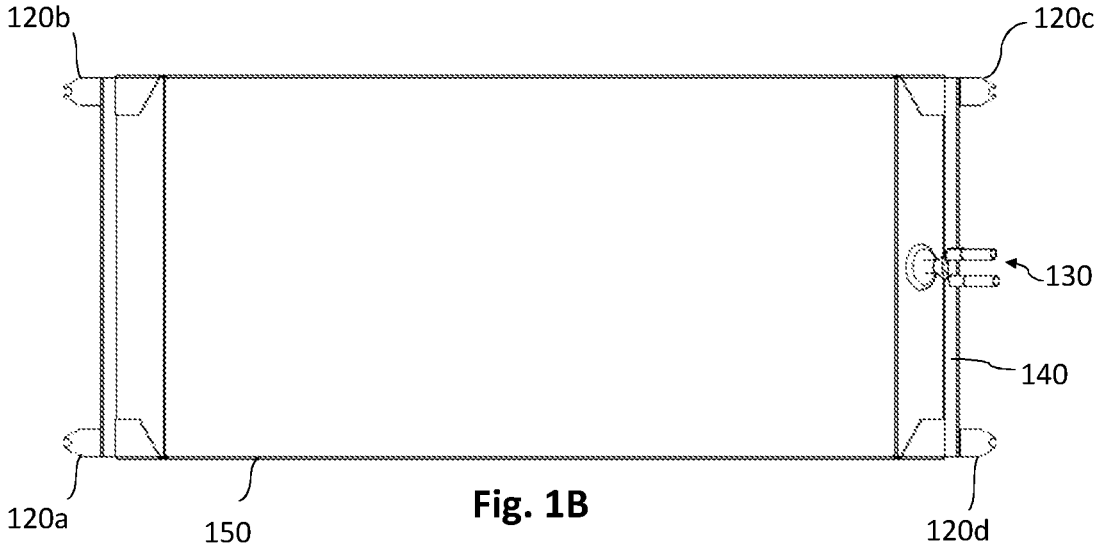
Figure 1C:
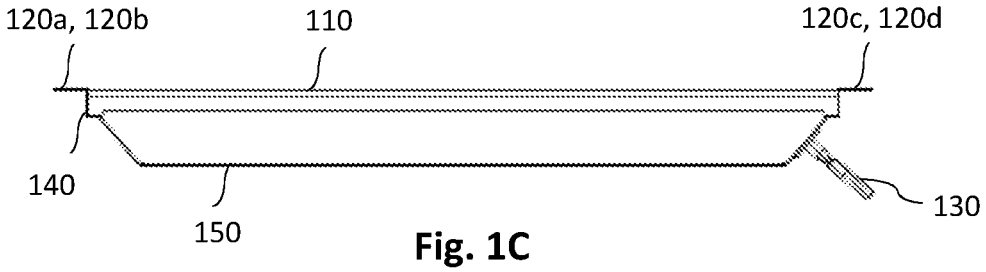

FIGS. 1A, 1B and 1C illustrate different views of an embodiment of a flat panel loudspeaker 100 for mounting in an opening in a mounting surface. The mounting surface (not shown) is an exposed surface of a structural component of a building, such as a wall, a ceiling, an air conditioning unit, or the like. In examples, the opening in the mounting surface is defined by a series of cuts in the mounting surface, resulting in a substantially rectangular opening in the mounting surface which is sufficiently deep to contain the flat panel loudspeaker. Alternatively, the opening can be provided by means of the construction of the mounting surface. In other words, the mounting surface can be formed to have the opening defined therein.

FIG. 1A provides a view of the loudspeaker 100, showing outwardly facing features of the flat panel loudspeaker 100. The loudspeaker 100 comprises a planar resonant panel 110. The resonant panel 110 extends across substantially the whole of a front surface of the flat panel loudspeaker 100. The resonant panel 110 is formed, in the embodiment of FIG. 1A, to have a four-sided front surface, in the form of a rectangular front surface. Suitable materials and methods of construction for manufacturing the resonant panel 110 for use to generate sound in a flat panel loudspeaker will be known to the skilled person. The rectangular front surface is defined by two short sides spaced apart and connected by two long sides, also spaced apart. As will be apparent, the short sides are shorter than the long sides and are the sides of the front surface perpendicular to the long sides. In other words, the front surface of the resonant panel 110 is rectangular. It will be understood that the present disclosure is not limited to a resonant panel having a front surface of a rectangular shape, and other shapes are also possible, for example circular.

The loudspeaker 100 further comprises at least one tab 120*a*, 120*b*, 120*c*, 120*d*, in the form of four tabs 120*a*, 120*b*, 120*c*, 120*d*. The tabs 120*a*, 120*b*, 120*c*, 120*d* extend away from the resonant panel 110 in a tab direction, as will be described further with reference to FIG. 1C hereinafter. In this embodiment, the four tabs 120*a*, 120*b*, 120*c*, 120*d* are provided substantially at, for example at, the corners of the front surface of the resonant panel 110. It will be understood that the present disclosure is not limited to having four tabs, and other numbers are also possible, for example two tabs. Each of the tabs 120*a*, 120*b*, 120*c*, 120*d*, in this embodiment, extends away from the short side of the front surface of the resonant panel 110. Each of the tabs 120*a*, 120*b*, 120*c*, 120*d*, in this embodiment, extends, of the short sides and the long sides of the front surface of the resonant panel 110, only beyond the short side of the front surface of the resonant panel 110. The skilled person would understand that in other examples, the at least one tab 120*a*, 120*b*, 120*c*, 120*d* can extend substantially away from, for example away from, a long side of the resonant panel. The at least one tab 120*a*, 120*b*, 120*c*, 120*d* can extend beyond the short side of the front surface of the resonant panel by a first extension amount greater than any second extension amount beyond the long side of the front surface of the resonant panel 110.

The loudspeaker further comprises connectors 130 for connecting cables to one or more internal electrical components of the loudspeaker 100.

The loudspeaker also comprises an exciter (not shown). The exciter is coupled to the rear surface of the resonant panel 110 and, when in operation, causes the resonant panel 110 to vibrate and generate sound. The exciter is typically operated by one or more electrical signals received via the connectors 130. The exciter is connected to the rear surface of the resonant panel via a 'foot' (not shown), for example a cylindrical foot. The exciter can be driven by the one or more electrical signal received at terminals thereof from, for example, an audio amplifier unit (not shown), via conductive cables attached to the connectors 130. When caused to vibrate by the exciter, the resonant panel 110 acts to amplify these vibrations in a similar manner to a soundboard of a violin or piano such that the flat panel loudspeaker 100 produces sound from the electrical signal. The above description of the operation of the exciter and the resonant panel 110 is provided merely for the convenience of the reader. The skilled person will understand how flat panel loudspeakers typically operate.

FIG. 1B provides a further view of loudspeaker 100, showing an inwardly facing aspect of the loudspeaker. The at least one tab 120*a*, 120*b*, 120*c*, 120*d* and the connectors 130 are again shown in FIG. 1B, but from a rear side.

The loudspeaker 100 also comprises a support frame 140. The rear surface of the resonant panel 110 is fixed to the support frame 140 around the whole of, or substantially the whole of, the outer boundary of the resonant panel 110. This ensures that when the resonant panel is mounted in the mounting surface, and when an operation of an exciter is causing the resonant panel to vibrate, the outer boundary of the resonant panel is fixed relative to the mounting surface. This helps to prevent any plaster layers covering the mounted loudspeaker from cracking or distorting. In this way, the loudspeaker 100 can remain invisible in the mounting surface.

The loudspeaker 100 in this example also comprises a mounting unit 150. The mounting unit 150 is mounted to the support frame 140 and is for receiving therein the exciter, the resonant panel 110, and other components of the loudspeaker 100. In particular, the mounting unit 150 can protect a rear portion of the resonant panel 110 and the exciter during installation of the flat panel loudspeaker 100 in the mounting surface. Furthermore, the mounting unit 150 can define a cavity rearward of the resonant panel 110. When the resonant panel 110 is actuated by operation of the exciter, sound generated rearwardly from the resonant panel 110 can resonate within the cavity defined by the mounting unit 150, enhancing the audio performance of the flat panel loudspeaker 100. When the loudspeaker 100 includes a mounting unit 150, the at least one tab 120*a*, 120*b*, 120*c*, 120*d* can extend directly from the mounting unit 150. In other words, the at least one tab 120*a*, 120*b*, 120*c*, 120*d* can be connected to the rest of the flat panel loudspeaker 100 via the mounting unit 150. In an alternative example, the at least one tab 120*a*, 120*b*, 120*c*, 120*d* can be connected to the rest of the flat panel loudspeaker 100 via the support frame 140.

FIG. 1C provides a side view of the loudspeaker 100. The resonant panel 110 is shown affixed to the support frame 140. The mounting unit 150 is affixed to the support frame 140 and supports the connectors 130. As best seen in FIG. 1C, the at least one tab 120*a*, 120*b*, 120*c*, 120*d* extends away from the support frame 140 in a tab direction. The tab direction is parallel to the mounting surface when the flat panel loudspeaker 100 is to be mounted in the mounting surface. In other words, the tab direction is parallel to the front surface of the resonant panel 110. The tab direction is also substantially flush with the front surface of the resonant panel 110 when the flat panel loudspeaker 100 is to be mounted in the mounting surface. In this example, a rear surface of the tab 120*a*, 120*b*, 120*c*, 120*d*, that is, the surface that engages with the mounting surface is arranged to be flush with the front surface of the resonant panel 110. In another example, a front surface of the tab 120*a*, 120*b*, 120*c*, 120*d*, that is the surface which faces away from the mounting surface, can be flush with the front surface of the resonant panel. The alternative approach is suitable where the tab 120*a*, 120*b*, 120*c*, 120*d* is to be indented into the mounting surface.

The opening in the mounting surface is sized to be larger than the resonant panel 110 and support frame 140, but small enough that when mounting the loudspeaker 100, the at least one tab 120*a*, 120*b*, 120*c*, 120*d* does not pass within the opening, and instead engages flush with the mounting surface to prevent the front surface of the resonant panel 110 from passing into the opening of the mounting surface. In other words, a size of the resonant panel 110 in combination with the at least one tab 120*a*, 120*b*, 120*c*, 120*d* is greater than the extent of the opening in the mounting surface.

Once the at least one tab is flush with the mounting surface and the loudspeaker 100 is within the opening of the mounting surface, the loudspeaker 100 can be fixed in place by means of a fastener engageable with the at least one tab, as described further with reference to FIG. 2 hereinafter. It will be understood that the loudspeaker 100 can be secured in the mounting surface by another means, for example gluing the loudspeaker 100 or a component thereof to the mounting surface.

The mounting unit 150 may be formed from metal, for example steel, or from another material, such as carbon fiber.

Figure 2:
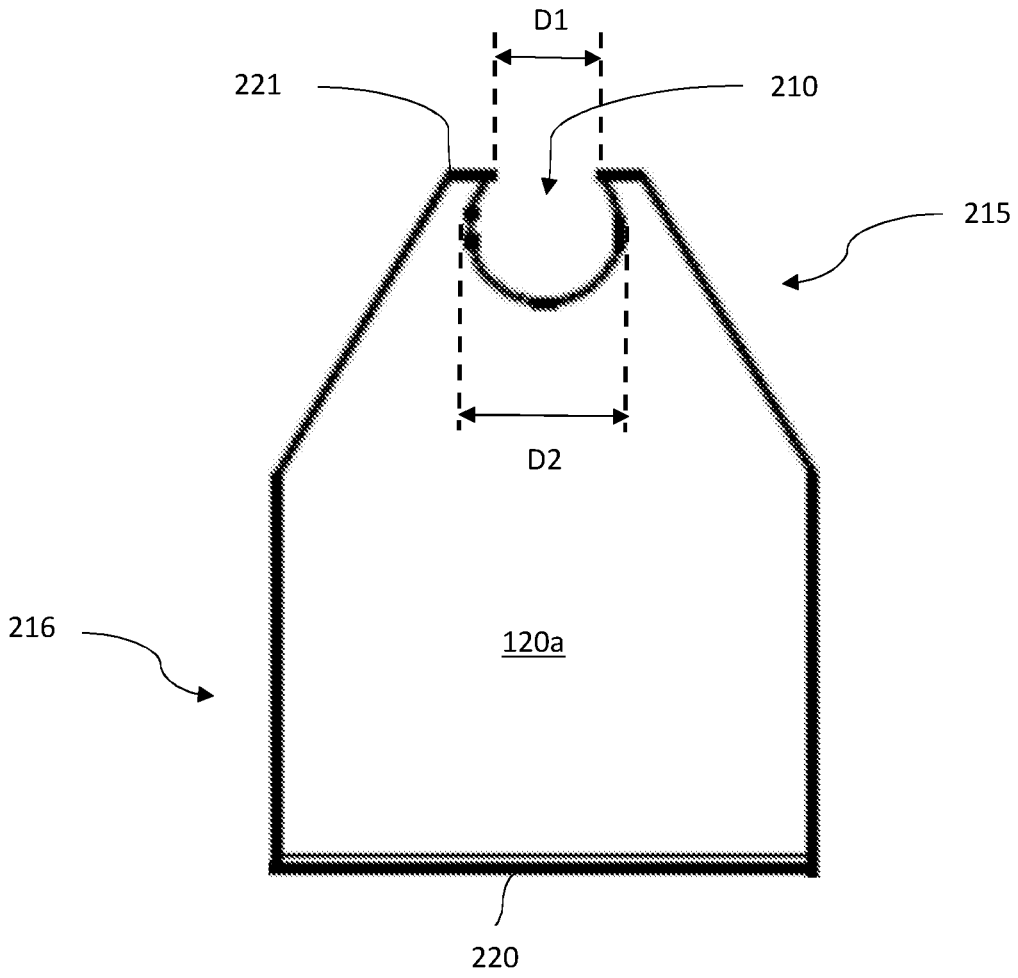
FIG. 2 is an illustration of a tab as disclosed herein.

FIG. 2 is an illustration of the tab 120*a*, shown in isolation. Each of the other tabs 120*b*, 120*c*, 120*d* of the flat panel loudspeaker described with reference to FIGS. 1A to 1C are substantially similar. The tab 120*a* has defined therein a through-recess 210. The through-recess 210 is provided in a distal portion 215 of the tab 120*a*. The through-recess 210 has a boundary which is at least partly concave. The boundary is to engage with a headed fastener, such as a screw or a nail, to secure the tab 120*a* to the mounting surface during mounting. The tab 120*a* is connected to the support frame 140 at a proximal portion 216 of the tab 120*a*, in particular at an inner edge 220 of the tab. The inner edge 220 is provided at an opposite end of the tab 120*a* to the through-recess 210.

When securing the loudspeaker to the mounting surface using a headed fastener, the shaft of the headed fastener can pass beyond the mounting surface and into a layer of a second material behind the material of the mounting surface. The second material is typically a stronger material than the material of the mounting surface, to provide a structural piece for the headed fastener to fix into, and to clamp the mounting surface between the tab and the second material. The second material could be a strip of wood, a wooden noggin, a ply layer, a plastic strip or a metal frame, although the second material is not limited thereto. The second material could already be present behind the mounting surface at the start of the installation, or could be fitted behind the mounting surface as part of the installation process.

In the example of FIG. 2, the through-recess 210 is an open recess 210 open at an outer edge 221 of the tab, such that the boundary of the recess 210 does not form a complete loop. The outer edge 221 is separate from the inner edge 220. The open recess can sometimes be referred to as a notch.

The through-recess 210 is narrower at an opening of the through-recess 210. The distance D1 at the opening of the through-recess is less than the distance D2 at the widest point of the through-recess. In this way, a headed fastener having a tapered head can be substantially centered in the through-recess 210. The boundary of the through-recess 210 can define an arc of a circle.

The through-recess 210 can be tapered in a through-direction of the tab 120*a*. In other words, the through-recess 210 may be countersunk, such that the diameter of the recess 210 at a front surface of the tab 120*a* is larger than the diameter of the recess 210 at the rear surface of the tab 120*a*. The rear surface is the surface that is engageable with the mounting surface during mounting of the flat panel loudspeaker 100. This allows the head of the headed fastener inserted into the recess to sit flush with the tab. For the avoidance of doubt, FIG. 2 is merely a diagrammatic representation of the tab 120*a*, and does not show the countersunk feature of the through-recess 210. An example of a countersunk through-recess is illustrated by reference to FIGS. 5A to 5C.

The tab 120*a* in this embodiment is formed from sheet metal, for example steel, which may be stainless steel, and is thin to minimize the number of layers of plaster that are required to cover the tab 120*a* to make the tab 120*a* appear invisible in the mounting surface once the loudspeaker 100 is mounted. It will be understood that the tab 120*a* could be formed from other materials, such as carbon fiber. The tab 120*a* could be made in one piece integrally formed with the resonant panel and/or the support frame.

The tab 120*a* has a thickness of less than 5 mm, for example less than 3 mm, for example less than 2 mm, for example less than 1 mm, for example, approximately 0.8 mm. The tab 120*a* has a thickness of at least 0.2 mm so that the tab 120*a* is sufficiently sturdy to remain attached to the rest of the flat panel loudspeaker 100 during mounting, and to engage with the mounting surface without being substantially deformed.

Figure 3A:
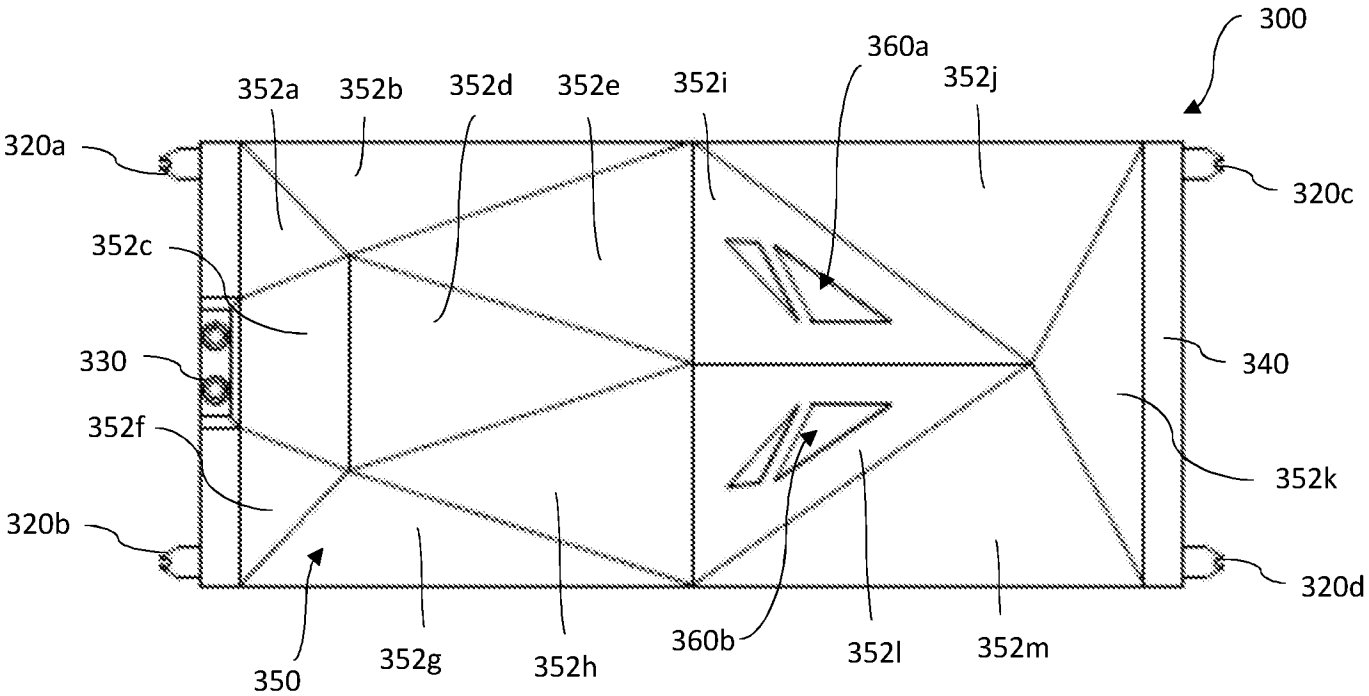
FIGS. 3A and 3B are illustrations of another embodiment of a flat panel loudspeaker as disclosed herein.
Figure 3B:
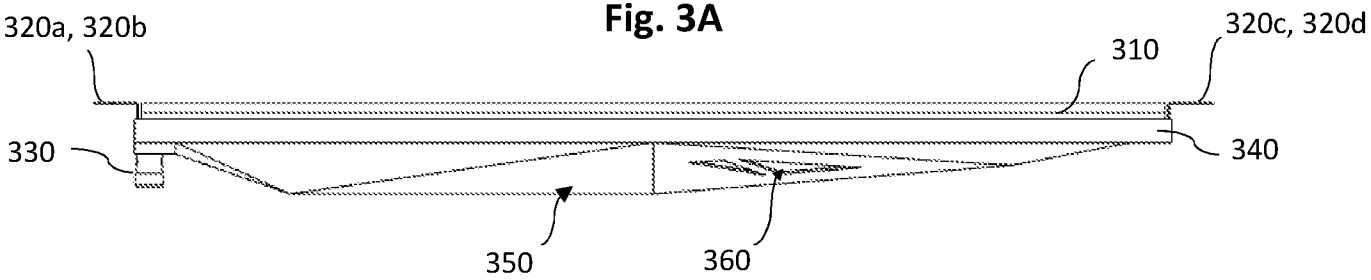

FIGS. 3A and 3B illustrate different views of another embodiment of a flat panel loudspeaker 300 for mounting in an opening in a mounting surface.

FIG. 3A provides a view of loudspeaker 300 from the rear of the device, and FIG. 3B provides a view of the loudspeaker 300 from the side. The flat panel loudspeaker 300 is substantially similar to the flat panel loudspeaker 100 described with reference to FIGS. 1A to 1C, including the tab 120*a* described with reference to FIG. 2, unless otherwise described hereinafter. As previously, the loudspeaker 300 comprises at least one tab 320*a*, 320*b*, 320*c*, 320*d* located substantially at a corner of a resonant panel 310. The rear surface of the resonant panel 310 is attached to a support frame 340 around substantially the whole of the outer boundary of the resonant panel 310.

The loudspeaker 300 also comprises an exciter (not shown), which is coupled to the rear surface of the resonant panel 310 and, when in operation, causes the resonant panel 310 to vibrate and generate sound. The support frame 340 supports the resonant panel 310, such that when the exciter is in use and causing the resonant panel to vibrate, the outer boundary of the resonant panel 310 is fixed relative to the mounting surface.

The loudspeaker 300 further comprises connectors 330, attached in this embodiment to the support frame 340. The connectors are used to connect external cables to one or more internal components of the loudspeaker 300.

The loudspeaker 300 further comprises a mounting unit 350. The rear surface of the mounting unit comprises a plurality of panels 352*a*, 352*b*, 352*c*, 352*d*, 352*e*, 352*f*, 352*g*, 352*h*, 352*i*, 352*j*, 352*k*, 352*l*, 352*m*. Panel 352*a* is a triangular panel with one edge adjoining the support frame 340, one edge adjoining panel 352*b*, and one edge adjoining panel 352*c*. Panel 352*b* is a triangular panel with one edge adjoining the support frame 340, one edge adjoining panel 352*a*, and one edge adjoining panel 352*e*. Panel 352*c* is a quadrilateral panel in the form of a trapezoidal panel with a first edge provided at the support frame 340, a second edge, parallel to the first edge, adjoining panel 352*d*, a third edge, connecting the first edge and the second edge and adjoining panel 352*a* and a fourth edge, also connecting the first edge and the second edge and adjoining panel 352*f*. Panel 352*d* is a triangular panel with one edge adjoining panel 352*c*, one edge adjoining panel 352*e*, and one edge adjoining panel 352*h*. Panel 352*e* is a triangular panel with one edge adjoining panel 352*b*, one edge adjoining panel 352*d*, and one edge adjoining panel 352*i*. Panel 352*f* is a triangular panel with one edge adjoining the support frame 340, one edge adjoining panel 352*c*, and one edge adjoining panel 352*g*. Panel 352*g* is a triangular panel with one edge adjoining the support frame 340, one edge adjoining panel 352*f*, and one edge adjoining panel 352*h*. Panel 352*h* is a triangular panel with one edge adjoining panel 352*d*, one edge adjoining panel 352*g*, and one edge adjoining panel 352*l*. Panel 352*i* is a triangular panel with one edge adjoining panel 352*e*, one edge adjoining panel 352*j*, and one edge adjoining panel 352*l*. Panel 352*j* is a triangular panel with one edge adjoining the support frame 340, one edge adjoining panel 352*i*, and one edge adjoining panel 352*k*. Panel

352*k* is a triangular panel with one edge adjoining the support frame 340, one edge adjoining panel 352*j*, and one edge adjoining panel 352*m*. Panel 352*l* is a triangular panel with one edge adjoining panel 352*h*, one edge adjoining panel 352*i*, and one edge adjoining panel 352*m*. Panel 352*m* is a triangular panel with one edge adjoining the support frame 340, one edge adjoining panel 352*l*, and one edge adjoining panel 352*k*.

The panels 352*a-m* are planar and are arranged in a plurality of different directions. In this way, sound interference can be reduced within the mounting unit 350, thereby improving the sound quality of the loudspeaker 300. In this particular example, the panels 352*a-m* each face in a different direction.

The mounting unit 350 can have defined therein at least one opening 360*a*, 360*b* in at least one of the panels 352*a-m*. In this embodiment, there are two openings 360*a* in panel 352*i* and two openings 360*b* in panel 352*l*, although this is just an example and the numbers and locations of the at least one opening 360*a*, 360*b* is not limited to these numbers or panels. The at least one opening 360*a*, 360*b* allows the sound produced by the exciter in combination with the resonant panel 310 to pass into a larger cavity provided within the mounting surface to resonate therein. This improves the acoustic performance of the loudspeaker 300, particularly for low frequency sounds, since low frequency sounds require larger spaces to fully resonate.

FIGS. 4 and 5A to 5C illustrate different views of another embodiment of a flat panel loudspeaker 400 for mounting in an opening in a mounting surface.

Figure 4:
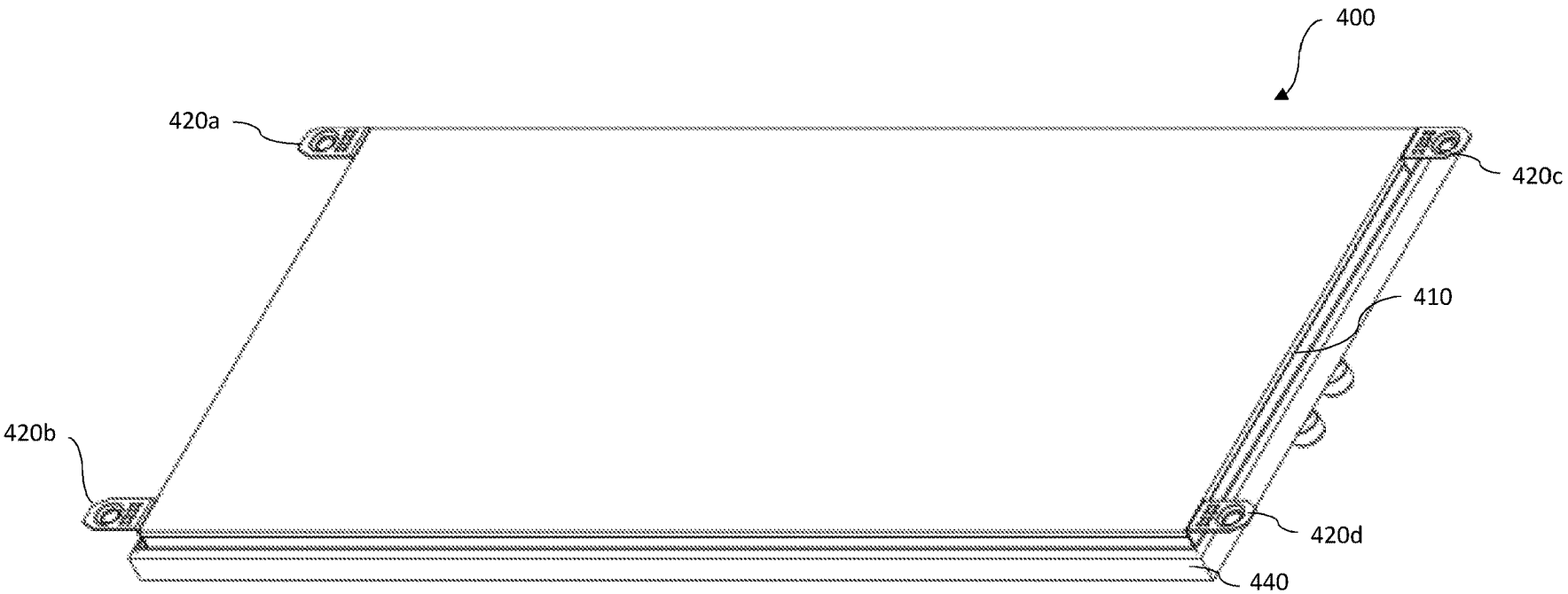
FIG. 4 is an illustration of an alternative embodiment of a flat panel loudspeaker as disclosed herein having different tabs.

FIG. 4 provides a top perspective view of loudspeaker 400. The flat panel loudspeaker 400 is substantially similar to the flat panel loudspeaker 100 described with reference to FIGS. 1A to 1C and the flat panel loudspeaker 300 of FIGS. 3A and 3B unless otherwise described hereinafter. As previously, the loudspeaker 400 comprises at least one tab 420*a*, 420*b*, 420*c*, 420*d* located substantially at a corner of a resonant panel 410. The rear surface of the resonant panel 410 is attached to a support frame 440 around substantially the whole of the outer boundary of the resonant panel 410. The loudspeaker 400 may comprise a mounting unit (not shown) such as the mounting units 150, 350 described previously. In this embodiment, each tab 420 has a through recess 470 with a closed boundary forming a hole to receive a fastener therethrough. The through-recess 470 is countersunk.

Although each of the tabs 420*a*, 420*b*, 420*c*, 420*d* in FIG. 4 have been shown located substantially at a corner of a resonant panel 410, another embodiment of the loudspeaker 400 is envisaged in which each of the tabs 420*a*, 420*b*, 420*c*, 420*d* are positioned spaced from the corners of the resonant panel 410. The inventors have realized that by arranging the tabs slightly spaced from the corners of the resonant panel, for example at least 10 millimeters from the corners of the resonant panel, the resonant panels 410, and indeed the assembled loudspeakers 400 can be transported with a reduced risk of damage to the tabs 420*a*, 420*b*, 420*c*, 420*d*. Since a correct location and shape of the tabs 420*a*, 420*b*, 420*c*, 420*d* is typically important for the accurate mounting of the loudspeaker 400 in the mounting surface, it is important that the tabs 420*a*, 420*b*, 420*c* 420*d* are not damaged in transit.

FIGS. 5A to 5C are respective perspective, plan and side view illustrations of the tab 420*a*, shown in isolation. Each of the other tabs 420*b*, 420*c*, 420*d* of the flat panel loudspeaker 400 described with reference to FIG. 4 are substantially similar. As described previously in respect of the tab 120*a* of FIG. 2, the tab 420*a* has defined therein a through-recess 470. The through-recess 470 is provided in a distal portion 415 of the tab 420*a*. The through-recess 470 has a circular boundary forming a hole. The boundary is to engage with a headed fastener, such as a screw or a nail, to secure the tab 420*a* to the mounting surface during mounting. The tab 420*a* is connected to the support frame 440 at a proximal portion 416 of the tab 420*a*, in particular at an inner edge 428 of the tab. The inner edge 428 is provided at an opposite end of the tab 420*a* to the through-recess 470.

The through-recess 470 is tapered in a through-direction of the tab 420*a*, thereby comprising a countersunk hole, such that the diameter D3 of the recess 470 at a front surface of the tab 420*a* is larger than the diameter D4 of the recess 470 at the rear surface of the tab 420*a*. The rear surface is the surface that is engageable with the mounting surface during mounting of the flat panel loudspeaker 400. This allows the head of the headed fastener inserted into the recess to sit flush with the tab. In this particular embodiment, a surface of the recess 470 at the rear surface of the tab 420*a* is configured to define a cutting portion to cut into an outer skin of the mounting surface when the rear surface of the tab 420*a* is provided against the mounting surface. In this way, the tab 420*a* can puncture through the outer skin of the mounting surface, ensuring that the portion of the tab 420*a* defining the through-recess 470 can act to at least partially crush an internal structure of the mounting surface below the outer skin. This further ensures that the tab 420*a* sits substantially flush with the mounting surface when mounted.

The tab 420*a* in this embodiment is formed from sheet metal, for example steel, which may be stainless steel, and is thin to minimize the number of layers of plaster that are required to cover the tab 420*a* to make the tab 420*a* appear invisible in the mounting surface once the loudspeaker 400 is mounted. It will be understood that the tab 420*a* could be formed from other materials, such as carbon fiber. The tab 420*a* could be made in one piece integrally formed with the resonant panel and/or the support frame.

Figure 6A:
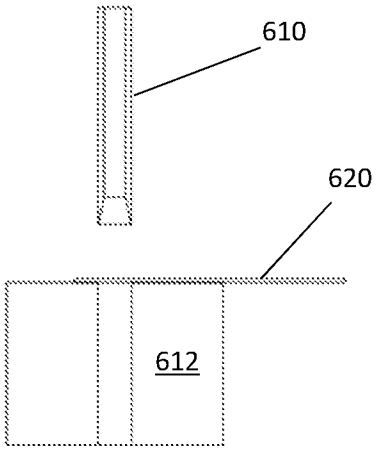
FIGS. 6A to 6F are schematic illustrations of steps in a manufacturing method for forming the tabs for the flat panel loudspeaker.
Figure 6B:
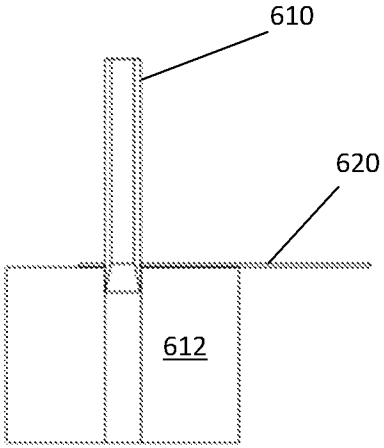
Figure 6C:
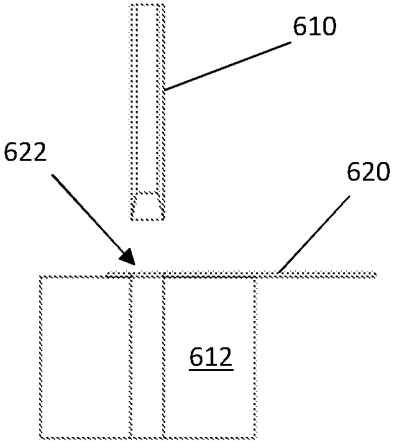

In one example, the through-recess 470 is formed by a punching process. The punching process is further illustrated with reference to FIG. 6A to 6F, as will be described hereinafter. In particular, the through-recess 470 can be formed in a two-stage punching process. In a first stage of the punching process, a first punch tool 610 as shown in FIG. 6A and having a first taper angle is provided adjacent a tab blank 620. The tab blank 620 is formed from sheet metal, and will become the tab as described hereinbefore, following the completion of the manufacturing process. As shown in FIG. 6B, the first punch tool 610 is lowered through the tab blank 620 into a first punch receiver 612 to pierce the tab blank 620 and subsequently separated from the tab blank 620 to reveal a first tab blank opening 622, as shown in FIG. 6C. The first punch receiver 612 has defined therein a first punch tool opening sized to be just larger than the first punch tool 610 for receiving the first punch tool 610 therein. In this way, an edge of the first tab blank opening 622 will not be deformed inwardly during piercing of the tab blank 620 by the first punch tool 610. As can be seen, the first taper angle of the first punch tool 610 can be substantially zero; in other words, the first punch tool 610 does not taper and maintains a substantially constant thickness at a punch tip of the first punch tool 610. The first punch tool 610 typically defines a circular cross-section configured to punch a circular opening in the tab blank 620 to form the first tab blank opening 622.

Figure 6D:
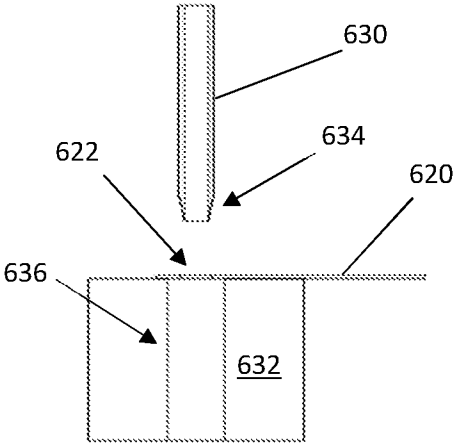
Figure 6E:
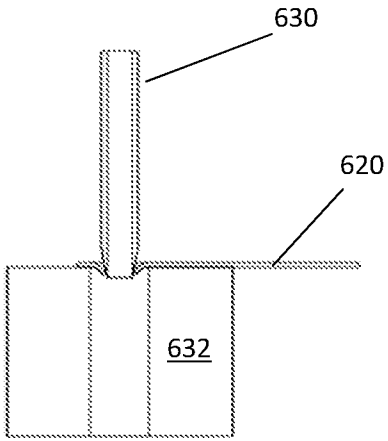
Figure 6F:
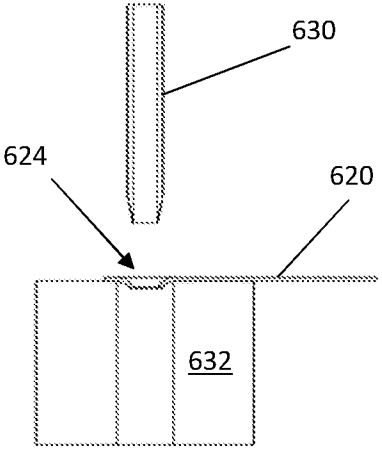

In a second stage of the punching process, as shown in FIG. 6D, the first punch tool 610 and the first punch receiver 612 are replaced by a second punch tool 630 and a second punch receiver 632. The second punch tool is provided with a punch tip 634 having a second taper angle, greater than the first taper angle; in other words, the punch tip 634 of the second punch tool 630 tapers towards the punch tip more than the first punch tool 610. The second punch receiver 632 has defined therein a second punch tool opening 636, larger than a footprint of the punch tip 634 of the second punch tool 630. The footprint of the punch tip 634 of the second punch tool 630 is typically substantially similar to a footprint of the punch tip of the first punch tool 610. In this example, the footprint of the punch tip 634 of the second punch tool 630 is smaller than the footprint of the punch tip of the first punch tool 610, such that the punch tip 634 of the second punch tool 630 can fit within the first tab blank opening 622 created by the first punch tool 610. As shown in FIG. 6E, the second punch tool 630 is lowered a predetermined amount into contact with the tab blank 620 to deform a boundary of the first tab blank opening 622, whereby to form the tab opening 624 shown in FIG. 6F. It will be understood that because the second punch tool opening 636 is wider than the punch tip 634 of the second punch tool 630, the boundary of the first tab blank opening 622 is able to deform with the direction of movement of the second punch tool 630 against the tab blank 620. Typically, the second punch tool 630 has a substantially circular cross-sectional profile, whereby to form a substantially circular tab opening 624 in the tab blank 620. As described hereinbefore, forming the tab opening 624 in this way ensures that a boundary of the tab opening can cut into the mounting surface, for example plasterboard, to substantially crush at least a portion of the mounting surface immediately adjacent to a skin layer, allowing the mounting tab to be engaged substantially flush with the mounting surface.

It will be understood that the mounting tabs described herein can be used for mounting substantially any apparatus in an opening in a mounting surface, for the advantages described hereinbefore.

Returning to FIGS. 4 and 5A to 5C, the tab 420*a* has a thickness of less than 5 mm, for example less than 3 mm, for example less than 2 mm, for example less than 1 mm, for example, approximately 0.8 mm. The tab 420*a* has a thickness of at least 0.2 mm so that the tab 420*a* is sufficiently sturdy to remain attached to the rest of the flat panel loudspeaker 400 during mounting, and to engage with the mounting surface without being substantially deformed.

It has been found that in particular where a tab is made from stainless steel, it can be difficult to adhere a plaster skim onto the relatively large flat area of the proximal portion, such as the proximal portion 216 of the tab 120*a* of FIG. 2. It has also been found to be important to space the through-recess 210 and associated fastener as far as practical from the cut edge of the opening in the mounting surface, to mitigate against cracking and damage to the materials at the cut edge. Adhesion of the plaster to the tab 120*a* over the distal portion 215 will be enhanced by the presence of the fastener head within the countersunk through-recess 210, such as a driver head interface, into which the plaster skim would fill to provide some mechanical interconnection. However, for a tab where the distance from the inner edge 220, 428 to the outer edge 221, 429 is about 25 mm, the distance from the inner edge 428 to the center of the through-recess 470 may be 17 mm, providing a good lateral spacing of the fastener from the cut edge. In such a tab, for a through-recess of 4 mm diameter, the length of the distal portion 216, 416, defined as the region extending from the inner edge 220, 428 to the inner edge of the through-recess 210, 470 will be about 15 mm, which is a relatively large flat area that may be prone to the plaster skim over it cracking.

Providing one or more surface features can therefore enhance the plaster adhesion to the proximal portion 216, 416. To this end, at least one perforation 450 in the form of an array of holes 450 is provided in the proximal portion 416 of the tab 420*a* of this embodiment. In use, a skim of plaster as applied to the tab 420*a* will cover the proximal portion 416, filling the holes 450. Once the plaster skim has set, the quantity of plaster filling the holes 450 will act as a mechanical connection between the skim layer and the surface of the tab 420*a*. An array of holes 450 is just one convenient way to enhance the plaster adhesion and it will be understood that other surface features, for example in the form of one or more partial recesses might be used instead for a similar purpose, although perforations 450 from one surface of the tab 420*a* to the opposite surface will mean that the plaster forms support columns all the way through the thickness of the tab 420*a*.

The tab 420*a* includes a support foot 460 extending proximally of the inner edge 428, in a plane parallel to the plane of the proximal and distal portions 416, 415 of the tab 420*a* and spaced therefrom by the inner edge 428. The support foot 460 is held between the support frame 440 and the resonant panel 410.

As well as the aesthetic and structural benefits of avoiding cracking in the plaster in the region above the tab 420*a*, an additional benefit of the perforations 450 is that it they also help to avoid any voids behind the plaster skim by allowing the plaster to flow through the perforations to the other side of the tab 420*a*, thereby filling any cavities or voids on that side. As well as additional structural integrity, this may prevent unwanted resonant effects that might otherwise have arisen due to the presence of voids in proximity to the loudspeaker 400.

The loudspeaker 100, 300, 400 is mounted by making an opening in a mounting surface wherein the opening is sized to fit the resonant panel 110, 310; 410 and the loudspeaker 100, 300, 400 therein. The loudspeaker 100, 300, 400 is inserted into the opening until the at least one tab 120*a-d*, 320*a-d*, 420*a-d* is pushed against the mounting surface and the resonant panel 110, 310, 410 is substantially flush with the mounting surface. The loudspeaker 100, 300, 400 is then secured in the mounting surface by means of the at least one tab 120*a-d*, 320*a-d*, 420*a-d* or by another securing means. The opening is sized to be large enough for the resonant panel 110, 310, 410, support frame 140, 340, 440 and mounting unit 150, 350 to fit within the opening, but small enough that the tabs 120*a-d*, 320*a-d*, 420*a-d* also do not pass into the opening, and instead engage with the mounting surface. The opening is deep enough for the resonant panel 110, 310, 410, support frame 140, 340, 440, exciter and mounting unit 150, 350 to pass within the opening without the rear of the loudspeaker 100, 300, 400 touching the rear of the opening. For example, for a flat panel loudspeaker of dimensions (not including the at least one tab) of 45×20×7 cm, the opening in the mounting surface could be 47×21×10 cm, or 48×22×15 cm. It will be understood that these dimensions are just examples and the size of the opening is not limited to these numbers or proportions.

In some examples, the at least one tab 120*a-d*, 320*a-d*, 420*a-d* can be configured to be removable from the loudspeaker 100, 300, 400 after the loudspeaker 100, 300, 400 is mounted in the mounting surface. The inventors have realized that when the loudspeaker 100, 300, 400 is inserted into the opening until the at least one tab 120*a-d*, 320*a-d*, 420*a-d* is pushed against the mounting surface and the resonant panel 110, 310, 410 is substantially flush with the mounting surface, the loudspeaker 100, 300, 400 can be adequately secured in the mounting surface by insertion of adhesive, or even plaster between the edge of the loudspeaker 100, 300, 400 and an internal edge of at least a portion of the opening in the mounting surface, for example at two opposing edges of the loudspeaker 100, 300, 400. In this example, the at least one mounting tab 120*a-d*, 320*a-d*, 420*a-d* may not include any through-recesses 470 as it may be intended that the mounting tab(s) 120*a-d*, 320*a-d*, 420*a-d* will be removed from the loudspeaker 100, 300, 400 before the loudspeaker 100, 300, 400 is plastered over in the mounting surface. The at least one mounting tab 120*a-d*, 320*a-d*, 420*a-d* can be configured to be detachably secured to the loudspeaker 100, 300, 400. In another example, the at least one mounting tab 120*a-d*, 320*a-d*, 420*a-d* can be configured to be frangibly secured to the loudspeaker 100, 300, 400. In this way, the at least one mounting tab 120*a-d*, 320*a-d*, 420*a-d* can be easily removed from the loudspeaker 100, 300, 400 once the loudspeaker 100, 300, 400 is correctly positioned flush in the mounting surface. It will be understood that the skilled person will be aware of a number of different means and methods by which the at least one tab 120*a-d*, 320*a-d*, 420*a-d* can be removably attached to the loudspeaker 100, 300, 400, for example to the support frame 140, 340, 440 or to the mounting unit 150, 350. In some examples, the at least one tab 120*a-d*, 320*a-d*, 420*a-d* can be removably attached directly to the resonant panel 110, 310, 410 and configured to be removed from the resonant panel once the loudspeaker 100, 300, 400 is positioned in the mounting surface.

In summary, there is provided a flat panel loudspeaker (100, 300, 400) for mounting in an opening in a mounting surface. The flat panel loudspeaker comprises a planar resonant panel (110, 310, 410) insertable into an opening in the mounting surface and having a front surface, the front surface to face outwardly in the mounting surface when the flat panel loudspeaker is mounted in the mounting surface, and the resonant panel further having a rear surface opposite the front surface. The loudspeaker further comprises an exciter coupled to the rear surface of the resonant panel to cause the resonant panel to vibrate on operation of the exciter, to generate sound. The loudspeaker additionally comprises a support frame (140, 340, 440) for mounting in the mounting surface and having the rear surface of the resonant panel fixed thereto around substantially the whole of the outer boundary of the resonant panel, such that when mounted in the mounting surface and when the resonant panel is caused by the exciter to vibrate on operation of the exciter, the outer boundary of the resonant panel is fixed relative to the mounting surface. The loudspeaker also comprises at least one tab (120*a-d*, 320*a-d*, 420*a-d*), configured to extend away from the support frame in a tab direction parallel to the mounting surface and substantially flush with the front surface of the resonant panel when the loudspeaker is to be mounted in the mounting surface, whereby to keep the front surface of the resonant panel substantially flush within the mounting surface when the tab is against the mounting surface.

Throughout the description and claims of this specification, the words "comprise" and "contain" and variations of them mean "including but not limited to", and they are not intended to (and do not) exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The disclosure extends to any novel one, or any novel combination, of the features disclosed in this specification (including any accompanying claims, abstract and drawings), or to any novel one, or any novel combination, of the steps of any method or process so disclosed.

What is claimed is:

1. A flat panel loudspeaker configured for mounting in an opening in a mounting surface, the flat panel loudspeaker comprising:

a planar resonant panel insertable into an opening in the mounting surface and comprising a front surface, wherein the front surface faces outward in the mounting surface when the flat panel loudspeaker is mounted in the mounting surface, and the planar resonant panel further comprises a rear surface opposite the front surface;

an exciter coupled to the rear surface of the planar resonant panel to cause the planar resonant panel to vibrate and generate sound in response to operation of the exciter;

a support frame for mounting in the mounting surface and having the rear surface of the planar resonant panel fixed thereto around substantially the whole of the outer boundary of the planar resonant panel, such that when mounted in the mounting surface and when the planar resonant panel is caused by the exciter to vibrate in response to operation of the exciter, the outer boundary of the planar resonant panel is fixed relative to the mounting surface; and at least one tab, configured to extend away from the support frame in a tab direction parallel to the mounting surface and substantially flush with the front surface of the planar resonant panel when the flat panel loudspeaker is mounted in the mounting surface, wherein the front surface of the planar resonant panel is substantially flush with the mounting surface when the tab is against the mounting surface.

2. The flat panel loudspeaker of claim 1 wherein the at least one tab comprises a plurality of tabs, and wherein one or more of the plurality of tabs are provided substantially at a corner of the front surface of the planar resonant panel.

3. The flat panel loudspeaker of claim 2 wherein each of the one or more of the plurality of tabs are spaced no more than 30 millimeters from the corner at which the respective tab is substantially provided.

4. The flat panel loudspeaker of claim 3 wherein an outer edge of each of the one or more of the plurality of tabs is spaced at least 10 millimeters from the corner at which the respective tab is substantially provided.

5. The flat panel loudspeaker of claim 1 wherein the front surface of the planar resonant panel is substantially rectangular, having two short sides and two long sides, and wherein the at least one tab extends in the tab direction beyond one of the short sides.

6. The flat panel loudspeaker of claim 5 wherein the at least one tab extends in the tab direction beyond the short side by a first extension amount greater than any second extension amount beyond the long side.

7. The flat panel loudspeaker of claim 6 wherein the at least one tab extends substantially from the short side.

8. The flat panel loudspeaker of claim 7 wherein the at least one tab extends only beyond the short side.

9. The flat panel loudspeaker of claim 1 wherein the at least one tab has a thickness of less than 1 mm.

10. The flat panel loudspeaker of claim 1 wherein the at least one tab has defined therein a through-recess having at least a partially concave boundary engageable by a headed fastener for securing the at least one tab to the mounting surface during mounting.

11. The flat panel loudspeaker of claim 10 wherein the through-recess is an open recess.

12. The flat panel loudspeaker of claim 10 wherein the through-recess is countersunk.

13. The flat panel loudspeaker of claim 12 wherein the through-recess defines a first recess portion disposed at a front surface of the tab and a second recess portion extending to a rear surface of the tab, wherein the second recess portion tapers more acutely than the first recess portion relative to an axis of the through-recess from the front surface of the tab to the rear surface of the tab.

14. The flat panel loudspeaker of claim 1 further comprising a mounting unit for mounting in the mounting surface and having the planar resonant panel and exciter provided therein.

15. The flat panel loudspeaker of claim 14 wherein the at least one tab extends from the mounting unit.

16. The flat panel loudspeaker of claim 14 wherein a surface of the mounting unit has defined therein at least one hole arranged to facilitate sound to pass from within the mounting unit out of the flat panel loudspeaker to a mounting cavity defined rearward of the mounting surface.

17. The flat panel loudspeaker of claim 1 wherein the at least one tab is frangibly connected to at least one of the support frame or the planar resonant panel.

18. A method for mounting the flat panel loudspeaker of claim 1 in a mounting surface facing outward, the method comprising:

inserting the flat panel loudspeaker into an opening defined in the mounting surface and sized to fit the planar resonant panel of the flat panel loudspeaker therein until the at least one tab is against the mounting surface, wherein the front surface of the planar resonant panel substantially flush with the mounting surface; and securing the flat panel loudspeaker in the mounting surface.

19. The method of claim 18 wherein the at least one tab has defined therein a through-recess having at least a partially concave boundary engageable by a headed fastener for securing the at least one tab to the mounting surface during mounting, the method further comprising forming the through-recess by:

performing a first punching operation using a first punch tool defining a first punch head; and performing a second punching operation using a second punch tool defining a second punch head, wherein the second punching operation is performed subsequent to the first punching operation.

20. The method of claim 19 wherein the first punch head is smaller than at least a portion of the second punch head.

21. The method of claim 19 wherein the first punch head tapers more acutely to a first punch tip than the second punch head tapers to a second punch tip.

22. The flat panel loudspeaker of claim 1 wherein the at least one tab extends in the tab direction beyond a side of the planar resonant panel.

23. The flat panel loudspeaker of claim 1 wherein the tab includes a proximal portion and a tapered distal portion, the tapered distal portion including a through recess.

* * * * *